United States Patent [19]

Crowley et al.

[11] Patent Number: 4,909,426

[45] Date of Patent: Mar. 20, 1990

[54] WEB FEED APPARATUS

[75] Inventors: H. W. Crowley, Newton; R. Langdon Wales, Lincoln; Albert L. Wright, Sherborn, all of Mass.

[73] Assignee: Roll Systems, Inc., Needham, Mass.

[21] Appl. No.: 354,016

[22] Filed: May 22, 1989

Related U.S. Application Data

[63] Continuation of Ser. No. 154,333, Feb. 10, 1988, Pat. No. 4,848,634.

[51] Int. Cl.[4] ..... B41F 13/54; B41J 15/00; B65H 26/00

[52] U.S. Cl. ..... 226/108; 101/228; 226/45; 400/578

[58] Field of Search ..... 226/25, 45, 101, 102, 226/108–110, 197; 101/228; 400/578

[56] References Cited

U.S. PATENT DOCUMENTS

| | | | |
|---|---|---|---|
| 3,240,411 | 3/1966 | Zarleng | 226/42 |
| 3,452,627 | 7/1969 | Goodman et al. | 83/110 |
| 4,009,814 | 3/1977 | Singh | 226/113 |
| 4,234,261 | 11/1980 | Hendrischk et al. | 400/621 |
| 4,500,043 | 2/1985 | Brown | 242/45 |

*Primary Examiner*—Thomas R. Hannon

*Attorney, Agent, or Firm*—Wolf, Greenfield & Sacks

[57] ABSTRACT

A web feed system for a laser printer that controls the feeding of web through the printer to a receiving device. The system includes an input feed station and an output feed station. At the output feed station there is a shock absorbing support roller and a series of rollers including a torque roller that support the web in a detection loop. Several features are incorporated to permit ease of transition between box and roll feed states.

18 Claims, 6 Drawing Sheets

WEB FEED APPARATUS

This application is a continuation of application Ser. No. 154,333 filed Feb. 10, 1988, now U.S. Pat. No. 4,848,634.

BACKGROUND OF THE INVENTION

1. Field of the Invention

The present invention relates in general to a web feed apparatus. More particularly, the present invention pertains to an apparatus for controlling web feed to and from a printer such as a laser printer. Even more particularly, the present invention relates to a feed control apparatus for permitting web feed from a roll to a printer, for printing and subsequent re-rollinq or folding.

2. Background Discussion

One printing apparatus to which the concepts of the present invention relate is an IBM 3800 laser printer. This laser printer is designed to accommodate paper in folded form from a feed box and is furthermore adapted, to deliver the paper in folded form to an output box after the printing has been carried out. One of the problems with the box-to-box feed is that boxes have to be replaced on a relatively frequent basis. On the other hand, a roll of paper can store the equivalent of up to thirty boxes and would thus would require far less frequent care taking.

Present attempts at modifying the laser printer to accommodate roll feeding have not been totally successful. Accordingly, it is an object of the present invention to provide an improved web feed apparatus that may be used with a laser printer or other form of utilization device modified to accept roll-fed paper. Another object of the present invention is to provide a modification to the printer apparatus so that it can readily accommodate either input box feed or input roll feed.

SUMMARY OF THE INVENTION

To accomplish the foregoing and other objects, features and advantages of the present invention, there is provided a web feed system for a utilization apparatus that controls the feeding of web through the utilization apparatus to a receiving apparatus and furthermore accommodates either input roll feed or folded feed. In the embodiment disclosed herein, the utilization apparatus is in the form of a laser printer and the present invention is adapted to provide an improved web feed system associated with the laser printer to enable the laser printer to have input thereto web material either from a roll or in folded form from a box. Moreover, the feed system of the present invention enables output feed either to a box supported on a table in the utilization apparatus, or outlet feed to a receiving apparatus, such as a rewinder or folder.

The web feed system of the present invention has an input feed station including means for receiving web in one of roll or fold form, and furthermore has an output feed station including means for outputting web in one of roll or fold form. The means for outputting web comprises support means of the utilization apparatus for guiding the web to an outlet port of the utilization apparatus. A shock absorbing guide means is disposed separate from but adjacent to the utilization apparatus for receiving the web. Web guidance means is disposed downstream of the shock absorbing guide means for directing web to the receiving apparatus. The web guidance means includes means for forming a web detection loop. Means are provided disposed at the web detection loop responsive to loop depth to detect a jam at the receiving apparatus.

In accordance with further aspects of the present invention, the input feed station may have disposed thereat a base housing for accomodating a web from an input roll feed means. This includes a web deflector bar for redirecting the web through a 90° turn to the input roll feed means. The input roll feed means comprises a pair of feed rollers and an associated web deflector disposed adjacent to the feed rollers. The base housing has a cover over the input roll feed means. The cover may be opened for roll feeding applications or closed to form a platform for box support to accommodate a fold input feed. Optical sensor means are provided at the output feed station for controlling a box support table thereat. Switch means are provided at the base housing responsive to movement of the cover to control the optical sensor means so a to permit the equipment to operate in the roll mode with the box support table fully lowered and out of the web path to the receiving device.

At the input feed station there is also provided a photo-sensor means to detect a web break to, in turn, interrupt feed through the utilization apparatus which, in the disclosed embodiment, is a laser printer. The photo-sensor means may comprise a light source on one side of the web and a photo-detector on the other side of the web. A slotted chamber is disposed about the photo-detector to permit light to pass therethrough. A second light source is disposed in the chamber and is selectively controlled to provide, from an externally generated signal, a stop indication by illuminating the second light source. Thus, the photo-detector may be operated by either a web break or by actuation of the second light source to simulate a web break to cause a stopping of operation. In this way, control external of the utilization apparatus may be provided to stop the feed through the utilization apparatus. This control may emanate from an input device such as an input roll machine adapted to feed web material from a roll to the laser printer.

The printer apparatus such as the IBM 3800 laser printer typically has in its output section a support table for supporting a box and also includes a housing frame. In accordance with the modifications of the present invention, support means are provided for use in the roll feed mode of operation for guiding the web. This support means is disposed in the frame and is in the form of a deflector. The aforementioned optical sensor means at the output feed station, in the normal box feed mode of operations, controls the table as to its vertically-disposed height.

Now, a switch means is preferably provided in accordance with the modifications of the present invention and previously mentioned in association with the input feed station at the base housing. This switch means has separate box and roll modes. The switch means enables the optical sensor means in the box mode and disables the optical sensor in the roll mode. The optical sensor means may comprise a pair of sensors. There may furthermore be provided a limit switch associated with the table. The limit switch control is also controlled from the switch means.

In accordance with the present invention there is also provided shock absorbing guide means that comprises a roller for redirecting the web from a substantially vertical course to a substantially horizontal course when in the roll feed mode. The web progresses over the aforementioned deflector supported in the laser printer to the shock absorbing guide means. A spring mounted support is provided for the shock absorbing roller. In the laser printer application there is an interruption in feed at predetermined intervals and the shock absorbing roller means absorbs this periodic feed interruption. The web detection loop is formed by a pair of support rollers having the loop depending therebetween. A further roller is disposed between the shock absorbing roller and the pair of support rollers forming the loop. A web break detector is disposed between the pair of support rollers and the shock absorbing roller. The means for detecting a jam comprises a jam detector for detecting the loop reaching the floor. A torque motor is provided for driving the one of the pair of support rollers closer to the utilization apparatus. A nip roller means is also provided at this one roller of the pair of support rollers. Associated with the receiving apparatus there is preferably also provided, in addition to the jam detector, a stop detector and a speed control detector.

BRIEF DESCRIPTION OF THE DRAWINGS

Numerous other objects, features and advantages of the present invention should now become apparent upon a reading of the following detailed description taken in conjunction with the drawings, in which.

DETAILED DESCRIPTION

The present invention is described in particular herein in association with improvements to a laser printer and, in particular, improvements to a laser printer such as the IBM 3800 laser printer. A printer of this type is primarily adapted for input feed of folded paper from a box and furthermore has a compartment supporting a table for outlet feed, after the printing has been completed. This outlet table may either support a box into which the folded paper is deposited or alternatively, the paper can be folded directly on to the table.

To modify a laser printer such as the IBM 3800 laser printer, for roll feed, would require substantial modification to the laser printers and would furthermore require removal of substantial components from the printer or replacement of components when interchanging between the different modes of feed. The present invention provides a web feed arrangement that enables one to very easily interchange between different feed modes, readily accomodating either input feed from a roll or input feed from a box. In accordance with the present invention there has been a modification to the laser printer construction, primarily in the form of additional components inserted into the laser printer construction that are adapted to not at all interfere with the normal box feed mode of operation of the printer and yet which are readily usable to enable roll feed to the laser printer. At the input feed station a feed roller arrangement is provided to enable input roll feed. This feed roll arrangement may be closed preferably by the use of a cover means, so that boxes can still be readily accommodated at the input feed station. At the output feed station, the laser printer is controlled so that the table can be maintained in its lowermost position in the roll feed mode of operation so that the table does not at all interfere with the outlet of web material, preferably by way of a deflector, to an output feed station. Furthermore, in accordance with the present invention the receiving device to which the web material moves has associated therewith means for forming a detection loop of web material, the position of which is sensed to determine whether the printing operation is to be stopped and for furthermore determining speed control, particularly in connection with the speed of intake of the web material by the receiving apparatus.

Figure 1:
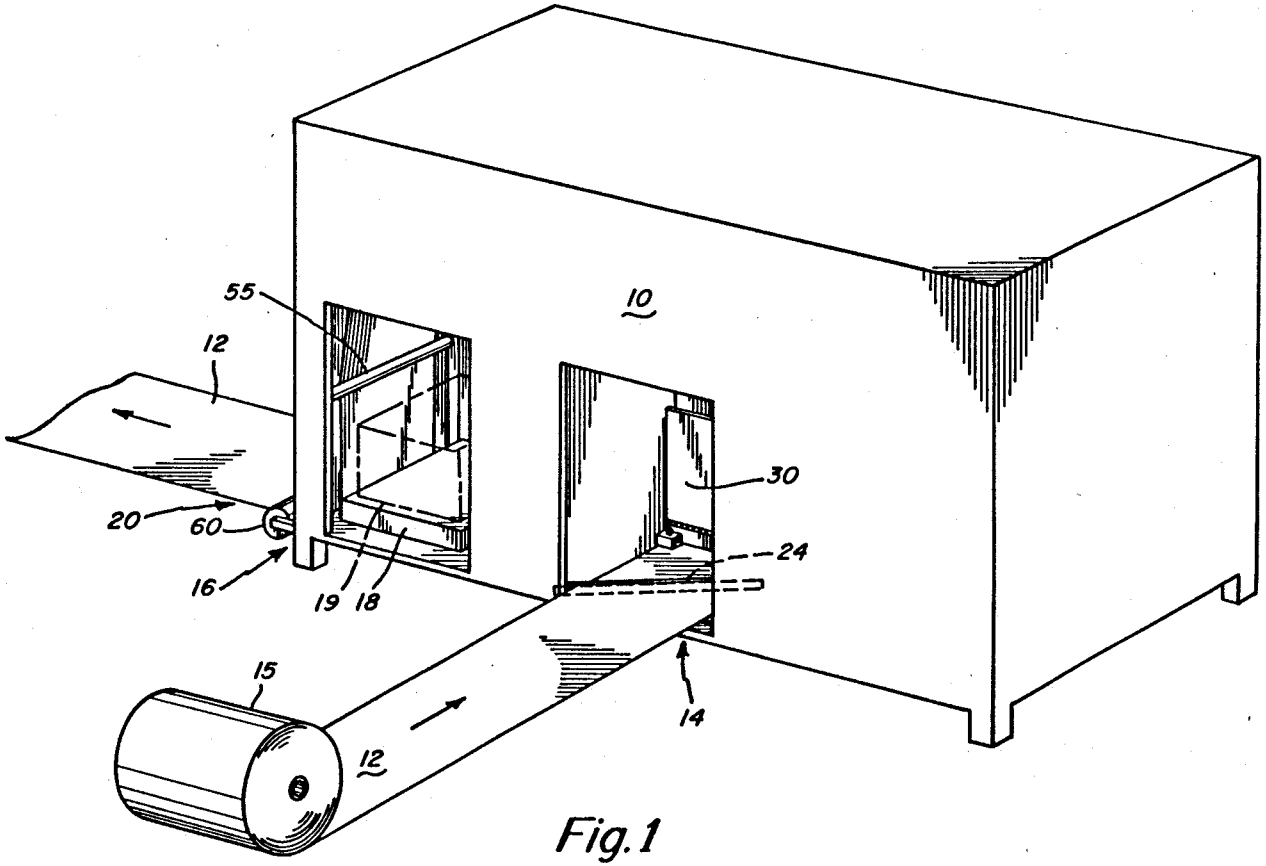
FIG. 1 is a schematic perspective view of a laser printer as modified in accordance with the improved web feed techniques of the present invention so as to readily accommodate either input roll or box feed.
Figure 2:
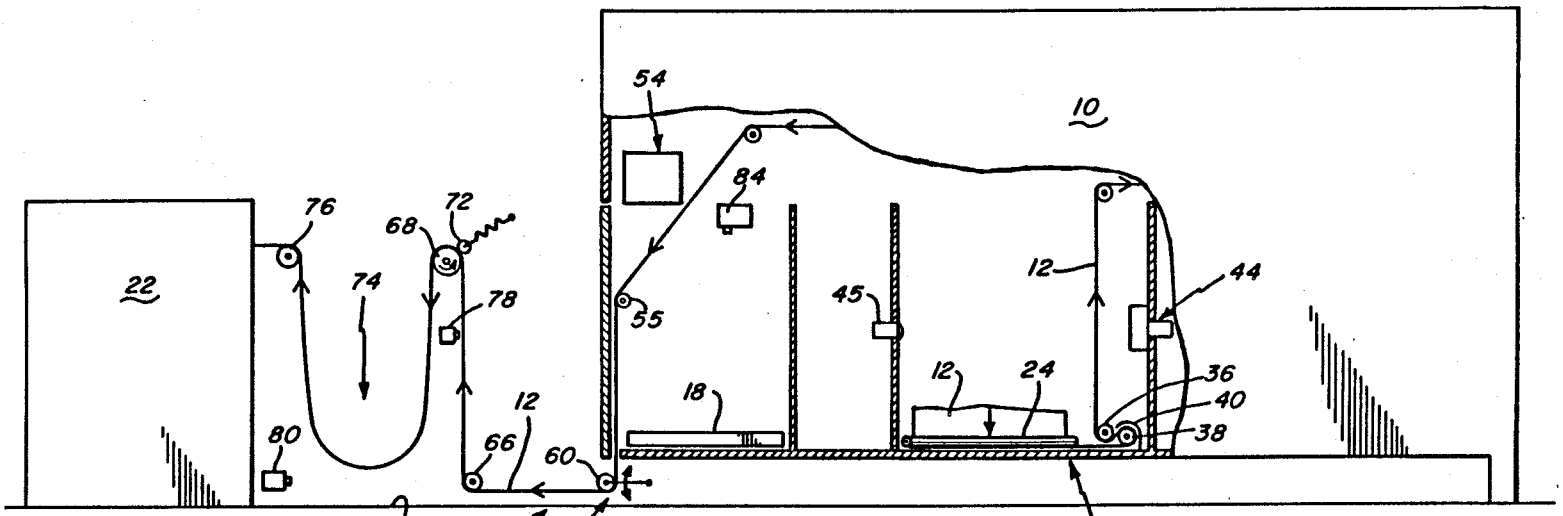
FIG. 2 is a schematic diagram in a side elevation view illustrating the course of the web in the laser printer and, furthermore, illustrating the input feed station, the output feed station and the detection loop coupling to a receiving apparatus.

FIGS. 1 and 2 illustrate a laser printer apparatus 10, also referred to herein as a utilization apparatus. The major parts of the laser printer may be as found in the IBM 3800 laser printer including a photoconducting drum that provides the printing on the web material. The web material is usually paper. The photoconducting drum is not specifically illustrated in the drawings herein. FIGS. 1 and 2 illustrate the paper web at 12. In FIG. 1 the web 12 is shown being directed into the machine at the input feed station 14. Similarly, the web 12, after having been printed thereon, is shown being fed out at the output feed station 16.

The paper web 12 may be coupled from a roll as illustrated schematically at 15 in FIG. 1. The roll 15 may be supported in a roll unwinding machine. In this regard refer to the assignee's earlier co-pending application Ser. No. 136,812 Filed Dec. 22, 1987 that gives further details of a roll machine that may be employed in feeding paper web to the laser printer of FIG. 1.

FIG. 1 also shows at the outlet end of the laser printer 10, a support table 18 that is adapted for support of a box illustrated in FIG. 1 in phantom outline. The printed folded sheets are directed to the box 19 when that is the desired output to be used. Alternatively, FIG. 1 also shows the shock absorbing guide means at 20 which is part of the equipment at the output feed station for controlling the outputting of the printed web which is subsequently coupled to a receiving apparatus as illustrated if FIG. 2 by the receiving device 22. The receiving device 22 may be in the form of a rewinding machine for rewinding the printed web back onto a roll or may be in the form of a folding machine for folding the web. A cutting device for cutting the web into sheets may alternatively also be employed as part of the post processing equipment.

Figure 3:
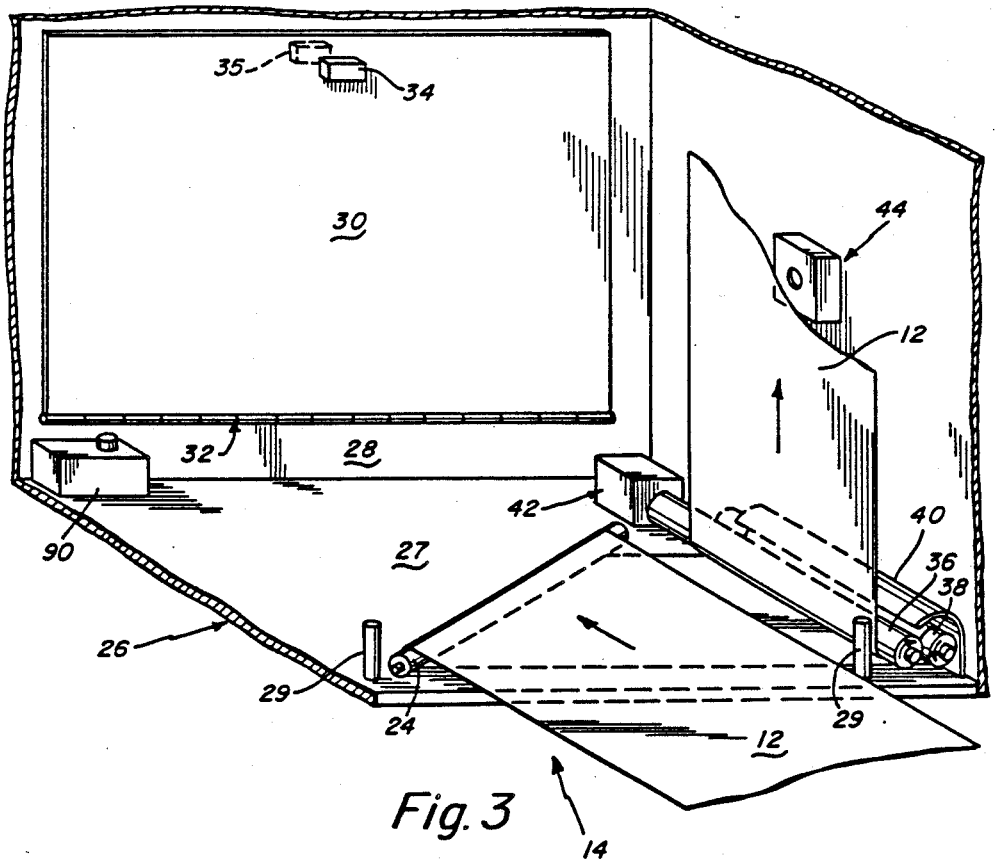
FIG. 3 is a fragmentary perspective view of the input feed station.

In connection with FIGS. 1 and 2, it is noted that the paper web 12 is taken from an external source to a turn-bar 24 that is supported diagonally in a base housing 26 at the inlet feed station 14. The base housing 26 has a bottom wall 27, rear wall 28, support legs 29 and a cover 30. The cover 30 is secured to the rear wall 28 by means of a hinge 32. All of the aforementioned details are shown in FIG. 3. In FIG. 3 the cover 30 is shown in its lifted position which is the position for accomodating input roll feed rather than input box feed. The input feed station can accommodate input box feed simply by moving the cover 30 to its downward position where it is held by gravity, engaging the front legs 29 so that the cover 30 is disposed substantially horizontally. It thus functions as a platform for support of a box and the paper is then fed in its normal manner into the laser printer. FIG. 3 also shows in this connection, the magnetic latch components 34 and 35 that enable the cover 30 to be maintained latched in an open position for roll accommodation.

At the input feed station 14 there is also provided a pair of suitably supported input feed rollers 36 and 38. Associated with the roller 38 is a deflector 40. The roller 36 are 38 driven from the motor 42. The paper turning deflector 40 greatly simplifies the webbing up of the paper either after a paper break or upon initial application of the paper. The paper 12 passes under the rollers 36 and 38, back around the roller 36 and into a vertical direction as illustrated in FIGS. 2 and 3

As indicated previously, there is a deflector 40 that is used for ease in input feeding. This deflector allows paper to be simply fed at the input feed station. The deflector guides the paper back again thus reversing the paper and speeding up the threading operation.

Figure 4:
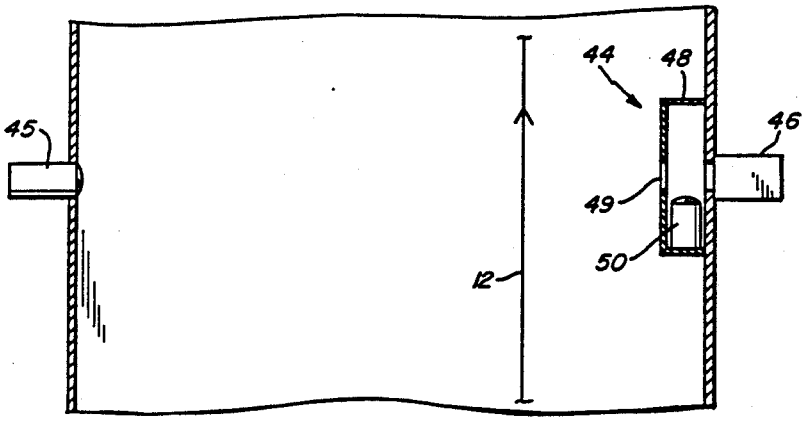
FIG. 4 is a more detailed view of the optical sensing arrangement at the input feed station.

Reference is now made to FIGS. 3 and 4 for further details of an optical sensor, also referred to herein as an external stop sensor and identified in FIG. 3 at 44. As illustrated in FIG. 4, the photo sensor is actually comprised of a light source 45, disposed on one side of the web 12 and a photo-detector 46 disposed on the other side of the web 12. This arrangement of light source 45 and photodetector 44 is found in the IBM laser printer. However, in accordance with the present invention for roll feed applications, rather than removing these components, they remain in the machine and the photodetector 44 is used in a different manner so as to enable automatic stopping of the laser printer under some type of external control. For instance, the machine feeding the roll to the laser printer may become jammed in which case it is desired to stop the laser printer. For this purpose there is provided chamber arrangement as illustrated at 48 in FIG. 4 and associated with the photodetector 46.

In front of the photo-detector 46 there is provided the relatively small chamber 48 that is slotted at 49 to permit light from the source 45 to reach the photo-detector in the event of a web break, in the box feed mode of operation. For the roll feed mode of operation, the chamber 48 also supports a second light source 50 directly within the chamber 48 but, as illustrated in FIG. 4, out of the direct path between the light source 45 and the photo detector 46.

The light source 50 is adapted for control from an external signal. When this light source is illuminated the photo-detector 46 responds because of a close proximity therebetween and this response signals the laser printer to stop operation. Thus, the laser printer can be controlled either directly by a web break, in either the box or roll mode of operation, by way of the photo detector 46 detecting light from the source 45 or the photodetector can be controlled by an external signal, in the roll mode of operation, that causes the light 50 to be illuminated to, in turn, trip the photo detector 46, to stop operation of the laser printer. This external signal is usually coupled from the pre-processing equipment feeding the paper at the input feed station. This coupling controls overall system operation so that if there are any paper feed problems in connection with the input feed to the laser printer, the laser printer can be interrupted in its operation to permit investigation of any such problems.

It is noted that, in connection with the components at the input feed station, that one can readily interchange between input box feed and input feed from a roll. For example, there may be applications in which there is a need to run a short job using one or more boxes rather than feeding from a roll. In this connection the hinged cover 30 with its magnetic latch can be lowered over the turn-bar assembly to provide a convenient platform to rest the box upon. This operation does not require the removal of the turn-bar assembly and one can interchange between the modes simply by raising or lowering the base housing cover 30.

In accordance with another feature of the present invention previously described, the system of the present invention enables both internal and external control of interruption of operation of the laser printer. This is carried out by the unique photo-sensor arrangement of the present invention as illustrated at 44 in FIG. 3. A past approach for stop sensors has been to make them readily replaceable so they can easily be removed when converting back to boxes. With our arrangement because our light source is close to the photo-detector it is not in the path between the light source 45 and the photo-detector 46. This means that the external stop sensor may be left in place, even though one converts back to boxes. One only has to disable the light source 50 by an external power control which is preferably part of a master switch, controlling the use of internal versus external input paper feed.

As indicated in FIG. 2, the web material then progresses into the laser printer. The internal mechanism of the laser printer is well known as exemplified by the IBM 3800 laser printer. The printer processes the paper producing the images controlled from a computer and feeds the paper to an output feed station 16. There are sensors at the output feed station to be described in further detail hereinafter.

The output feed station sensors are illustrated in FIG. 2 generally at 54. In the arrangement illustrated in FIG. 2, in the roll feed mode of operation, the paper, rather than being refolded in a box at the table 18, instead is coupled to a deflector 55 which permits the paper to run between the frame 56 and the door 58 at the very end of the laser printer. For further details refer to FIGS. 6 and 7 herein. At the very bottom of the printer outside thereof, there is provided a dancer roll 60 supported at 62 and balanced by virtue of springs 64. This spring mounted, shock absorbing web guide means accommodates the fact that the printer stops every seventy-seven inches to accommodate a non-continuous, photo conducting drum. This periodic stopping shock is taken up by the spring mounted dancer roll 60.

Figure 6:
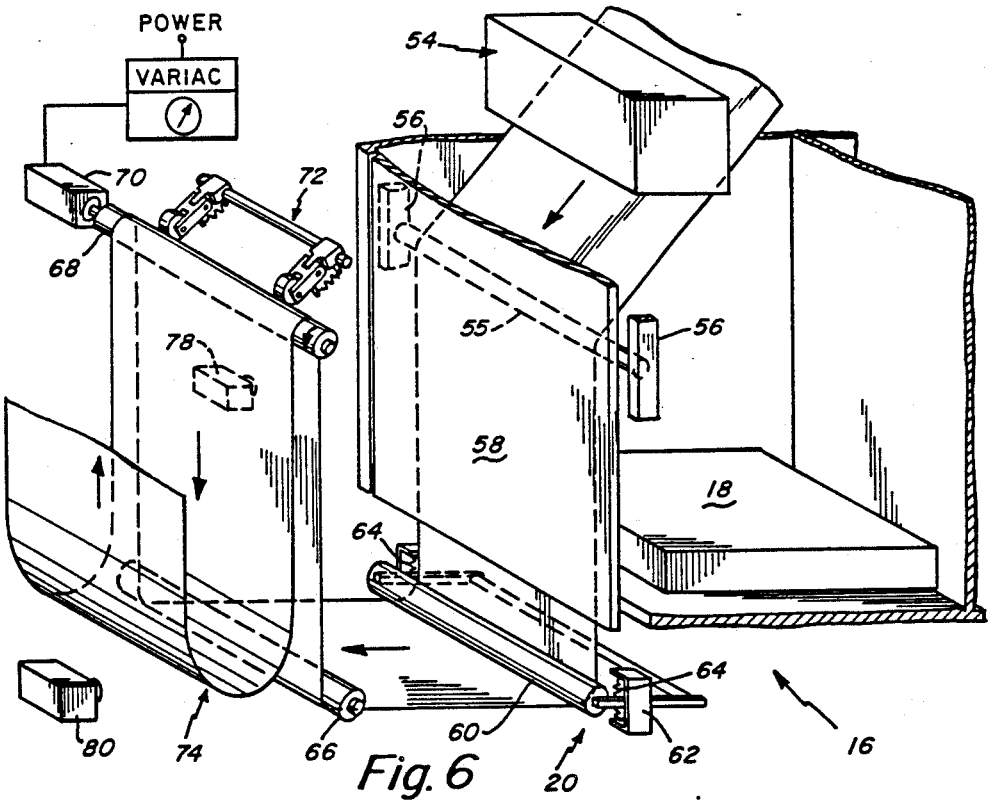
FIG. 6 is a fragmentary perspective view illustrating the output feed station in a further detail.
Figure 7:
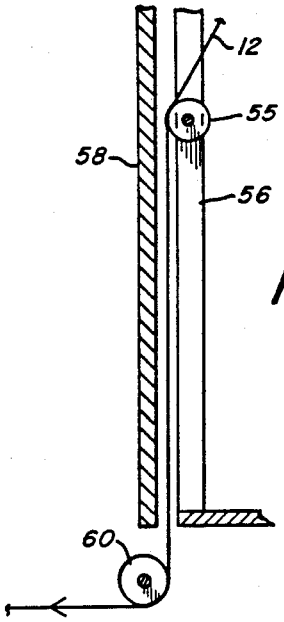
FIG. 7 is a fragmentary side elevation view showing somewhat more detail of the outlet deflector bar associated with the laser printer.

As indicated previously, and as illustrated in FIG. 6, the paper goes around a deflector bar 55 that is mounted just behind the door as illustrated if FIG. 7 and is out of the way of any boxes that might need to be put back in for later conversion back to the traditional boxes. The spring mounted shock absorbing dancer roll 60 is mounted outside of the main laser printer so that it is not in the way and so that it need not require removal in order to be able to accommodate boxes on the table 18, when in the box feed mode of operation.

The paper deflector 55 is preferably a permanent part of the laser printer and does not require removal by the operator in order to convert back to boxes. The external mounting of the spring mounted dancer roll 60 means that there is not any interference with the operator's ability to quickly place a box in the output section on the descending table 18 when changing to the box feed mode of operation.

After the paper web passes over the dancer roll 60, as illustrated in FIG. 2 and 6, the paper progresses over the roller 66. FIG. 6 shows the roller 68 driven in the direction of the arrow illustrated by means of the torque motor 70. The torque motor 70 provides a very precise and constant pull. The paper maintains contact with the torque roller 68 by means of a pair of nip rollers, illustrated at 72 in FIG. 6.

It is noted that the torque motor control does not require any sensor to adjust its speed. One can dial in its torque directly and it remains at the speed at which paper is supplied while maintaining uniform force.

With further reference to FIG. 2, it is noted that the paper web is formed into a loop 74 between the torque roller 68 and roller 76. The web is then fed to a receiving device 22 that may be a rewinding machine for rewinding the web onto a roll or may be a folding machine. A cutting apparatus may also be associated with the receiving device 22. As also indicated in FIG. 2, there are two detectors associated with the output feed station. These sensors include a web break detector 78 and a jam detector 80. The web break detector 78 may be an optical detector or other form of detector that examines the paper at an area that is under tension. That is illustrated in FIGS. 2 and 6, the web break detector 78 is positioned between the rollers 66 and 68. In the position illustrated in the drawings, one is assured that if a paper break occurs the detector, will be cleared and an unambiguous break thus identified.

The web break detector 78 is preferably disposed in an area where there is tension in the web and at a position along a vertical extent of the web so that if the web breaks, the web will fall by gravity and thus a web break will be immediately detected. In this regard the web detector 78 may also be positioned at about the same vertical height but facing the loop 74.

The jam detector 80, it is noted is disposed very close to the floor 81. This detector detects a jam in the post-processing equipment such as in the receiving device 22. A jam in the receiving prevents the paper from being taken up in a timely manner. In this event the jam detector detects this jam and would then control the laser printer to stop operation.

Thus, the jam detector 80 detects if a loop of paper, after the torque motor roller, is able to touch all the way to the floor. This means that the post-processing equipment is not drawing the paper and is perhaps jammed. This signal is utilized to stop the laser printer.

With respect to the web break detector 78, as indicated previously, its placement is important in guaranteeing that the paper will be separated if it breaks. This is assured by the two opposing forces one from the torque motor and one from gravity.

The post-processing jam detector 80 is an improvement over prior techniques of trying to actually monitor actual paper usage to be sure that the paper in is essentially the same as the paper out. This has been done in the past by examining holes in the pin-feed paper and counting holes out versus the holes in. The approach in accordance with the present invention is to realize that a loop of material between output and input sections has a loop of paper that lengthens when the input speed exceeds the output and shortens when the output speed is greater. The change in loop length $=\frac{1}{2}\int t/o\ (Vout - Vin)dt$. When a post-processing jam occurs, the loop lengthens rapidly and the detector has only to detect that the paper has become too long, meaning that the laser printer has provided more paper than the post-processing system has withdrawn.

Figure 5A:
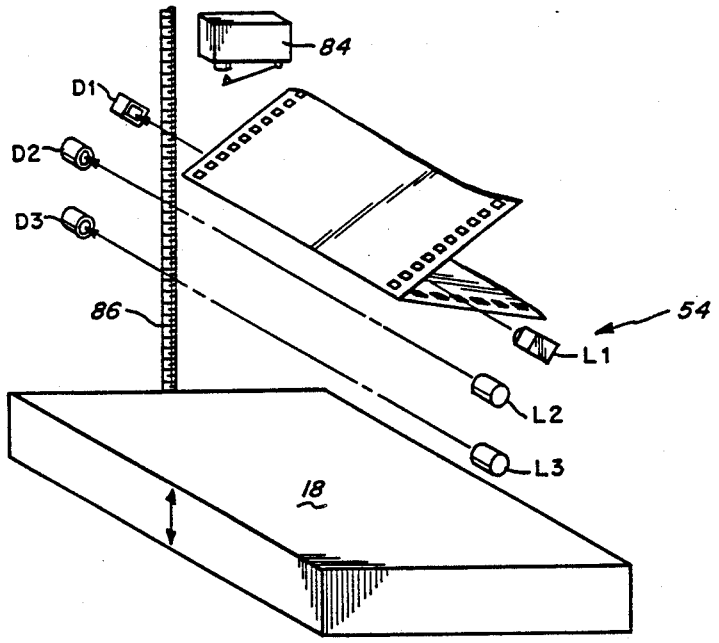
FIG. 5A schematically illustrates the output support table of the utilization apparatus with associated optical sensors and limit switch.

Reference has been made hereinbefore to the sensors 54 at the output section of the printer. The laser printer has three lights, illustrated in FIG. 5A as lights L1, L2 and L3 each having associated therewith corresponding photo detectors D1, D2 and D3. FIG. 5A shows these three lights and associated detectors and also a limit switch 84. FIG. 5A also shows the table 18 being controlled by a lead screw 86. When normally using a box disposed on table 18, the three lights and the limit switch control the descending table 18 normally used for the refold operation in a traditional box-feed input and output system. The light L1 and associated detector D1 provide a pulse output for essentially counting folds. The light L2 and detector D2 sense large excess stack heights for control of high-speed table retraction sense and the light L3 and detector D3 sense small excess stack heights for control of low-speed table retraction. As the stack increases in height the light sensors are activated to move the table down so as to maintain the proper folding action.

As indicated, the lights L2 and L3 provide an indication that the table should be lowered in order to keep the stack uniform. In the output section, the light L1 provides a detector that makes sure that the paper folds progress continuously and generates a signal to stop the printer if there is not an plurality of dark to light transitions whenever the paper is in motion.

The limit switch 84 mechanically detects when the table is in its uppermost travel position to disable the power.

Figure 5B:
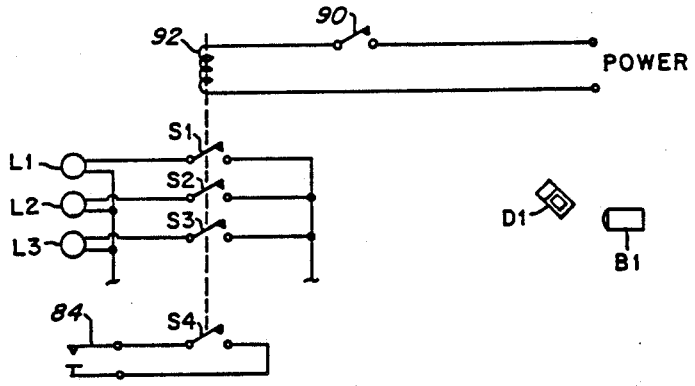
FIG. 5B is a circuit diagram of an additional circuit added for optical sensor and limit switch control and including a switch means for setting box and roll modes.

Now, in accordance with the present invention there is provided a mode switch illustrate in FIG. 5B by the switch 90. This mode switch may be operated between two different positions, one for selecting a box output permitting enabling of the sensors for controlling the table 18 and the other a roll output. In this connection, in FIG. 5B when the switch 90 is closed the relay 92 is operated and all of the switches S1–S4 are closed. This means that all of the lights are operable and that the limit switch 84 is also operable. This would be in the "box" position of the switch 90. When the switch 90 is opened then all of the lights L1–L3 as well as the limit switch 84 are essentially inhibited from operation.

The limit switch 84, as mentioned previously, is opened by switch contact S4 in the roll mode of operation. This signals the laser printer that the table is in its uppermost position which is the properly initiated position for commencing printer operation. The contact S4 simulates this upper position of the table even though the table has been manually moved down so that it will be out of the way for the input roll feed mode of operation.

In accordance with a further feature of the present invention, also illustrated in FIG. 5B, a blinking LED B1 is added to be in a position adjacent to paper folding detector D1 previously referenced in FIG. 5A. The LED B1 may be coupled to an oscillator to provide the blinking. This LED B1 is simulating the folding action when the system is in the "roll" mode. This provides to the printer the paper motion signal it requires in order to run. This signal can be used by the post-processing circuitry to indicate that there is a problem with the post-processing equipment by simply turning the LED B1 off. This synthetic fold sensing function can also be implemented by shunting the photo receptor D1 with an eletronic switch. A short time thereafter, the laser printer is put into an alarm condition due to the loss of this signal. Thus, the circuitry normally connected from the detector D1 for controlling the laser printer is now controlled in a different manner by virtue of providing the blinking LED B1 that may be controlled from a post processing equipment to control overall system operation.

Thus, in accordance with the present invention existing detectors in the laser printer may be used for control purposes without requiring substantial modification depending upon whether the output is in roll or box form. This is carried out in accordance with the present invention without removal of any components from the laser printer and is carried out primarily by means of a simple movement of a mode switch. The approach in accordance with the present invention is to disable all of the lights electrically and provide an external oscillator to satisfy the paper-fold sensor. This is the blinking LED B1 in FIG. 5B. This external oscillator and blinking light or detector shunt can be disabled by post-processing equipment to cause the laser printer to stop and display a stop status code, providing further enhancements of the laser printer utilizing some of its internal status codes. The internal status codes are interpreted to the operator by labels which are attached in his IBM status code book indicating the alternative meanings for the status codes when feeding equipment is being utilized.

In FIG. 5B, as discussed previously, there is disclosed the mode switch 90. It is preferred to have this switch 90 disposed in the manner illustrated in FIG. 3 so that it can be activated from the cover 30. In this way one need not separately actuate the switch 90 but instead the switch is activated indirectly by simple movement of the cover 30 between open and closed positions. This thus provides switching from one mode to the other on a substantially automatic basis.

Alternatively, the mode switch 90 may be a manually operated separately mounted switch such as one mounted at the input roll feed machine.

Figure 8:
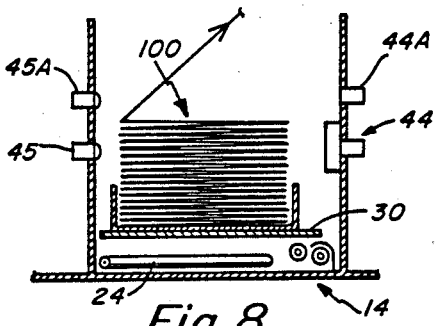
FIG. 8 is a fragmentary view of a preferred alternate placement for the web break detection sensor at the input feed station.

In connection with the modifications to the laser printer as in accordance with the present invention, reference is now made to FIG. 8 for an alternate embodiment of the invention. When incorporating the input feed rolls as illustrated in FIG. 8 at the input feed station 14, additional height is provided by means of these components so that the cover 30 is at an elevated position as illustrated in FIG. 8. It has been found that, for at least some cases, the input feed stack illustrated at 100 in FIG. 8 is, in its initially inserted position, too high and the stack itself thus blocks the light source 45 and detector 44. Accordingly, in an alternate preferred embodiment of the invention at the input feed station there is provided a separate light source 45A and separate detector 44A. The detector 44A and light source 45A are preferably used in the box feed mode of operation so as to properly detect a web break. The light source 45A and detector 44A are above the stack and thus can continuously detect a web break. When a break is sensed by light from source 45A reaching detector 44A, this signal is used to activate light source 50 which in turn activates detector 46 thus signaling the break to the printer and causing it to stop. The detector 44 and the light source 45 can be used for web break detection in the roll feed mode of operation.

Figure 9:
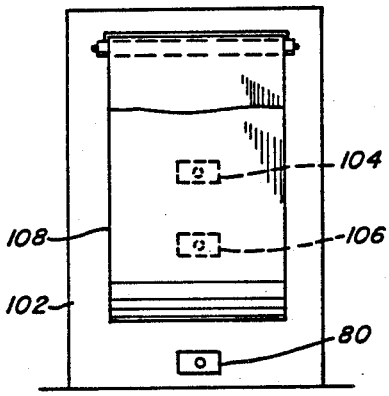
FIG. 9 is a schematic diagram of an alternate form of detection at the output end of the system including, stop, jam and speed control detectors.

In accordance with another alternate embodiment of the invention, reference is made to FIG. 9. FIG. 9 is a side elevation view as taken at the receiving apparatus illustrated in FIG. 9 at 102. FIG. 9 illustrates the web material at 108. This would be in the form of a loop as illustrated, for example, in FIGS. 2 and 6. FIG. 9 also shows the jam detector 80 as previously illustrated and described in connection with FIG. 2. FIG. 9 also illustrates a stop detector 104. This detects an indication when the loop 74 becomes too small. This may occur because the laser printer has stopped and in that instance, one then wants to immediately stop the receiving device. The detector 104 detects this condition and can be used to stop the receiving device 22. Between the detectors 80 and 104 is a speed control detector 106. This controls the speed of operation of the receiving device 22. This may control a motor in the receiving device 22 between high and low speed settings so that the web material drawn into the receiving device is synchronized with the speed of operation of the laser printer. All of the detectors 80, 104 and 106 may be standard optical detectors including transmit and receive portions that simply detect the presence or absence of a reflection from the web material.

Figure 10:
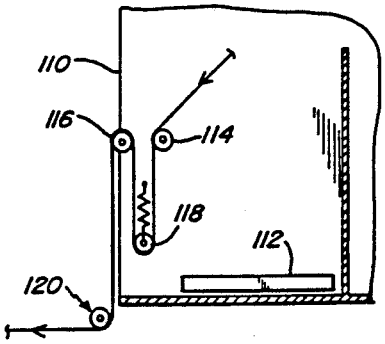
FIG. 10 is a schematic diagram of an alternate mounting arrangement for the shock absorbing roller, mounted within the laser printer itself.

FIG. 10 shows an alternate embodiment of the present invention in which the shock absorbing guide means is disposed within the laser printer. In FIG. 10 the laser printer cabinet is illustrated at 110. FIG. 10 also shows the output table 112. Mounted from the frame of the laser printer is a deflector 114 and a guideroller 116. In the embodiment of FIG. 10 the spring mounted roller is illustrated at 118 and is mounted on or within the laser printer cabinet. Outside of the cabinet there is provided a normal roller 120 that need not be a spring mounted roller. With the arrangement illustrated in FIG. 10 the shock absorbing roller 118 carries out all of the shock absorbtion within the utilization device itself so that the web feed is more uniform, at the output of the laser printer.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A web feed system for a utilization apparatus that controls the feeding of web through the utilization apparatus to a receiving apparatus and accommodates either input roll feed or folded feed, said system comprising:

an input feed station including means for receiving web in one of roll and folded form, and an output feed station including means for outputting web in one of unfolded and folded form, said means for outputting web comprising first support means for guiding said web to an outlet port of said utilization apparatus when outputting in unfolded form, said means for outputting web comprising second support means for receiving said web when outputting in folded form, said means for receiving web comprising first support means for receiving said web at an inlet port of said utilization apparatus when inputting in roll form, said means for receiving web comprising second support means for receiving said web thereat when inputting in folded form.

2. A system as set forth in claim 1 wherein said input feed station comprises a base housing for accommodating input roll feed means.

3. A system as set forth in claim 2 including a web turn bar for re-directing web thru 90° to said input roll feed means.

4. A system as set forth in claim 3 wherein said input roll feed means comprises a pair of feed rollers and a deflector disposed adjacent said feed rollers.

5. A system as set forth in claim 2 wherein said base housing has a cover over said input roll feed means, said cover open for roll feed and closed to form a platform for box support to accommodate a fold input feed.

6. A system as set forth in claim 5 including optical sensor means at the output feed station for controlling a box support table thereat, and switch means at said base housing responsive to cover action to control said optical sensor means.

7. A system as set forth in claim 2 including photosensor means at said input feed station to detect a web break to interrupt feed through the utilization apparatus and comprising a light source on one side of the web and a photodetector on the other side of the web.

8. A system as set forth in claim 7 further comprising a second photo sensor means disposed over the aforementioned photo sensor means and also comprising a light source on one side of the web and a photodetector on the other side of the web.

9. A system as set forth in claim 8 including a slotted chamber about said photo-detector to permit light to pass thereto.

10. A system as set forth in claim 9 including a second light source disposed in said chamber and selectively controlled to provide, from an external location, a stop signal by illuminating said second light source.

11. A system as set forth in claim 1 wherein said utilization apparatus has a table for supporting a box at the output feed station and a frame, said support means for guiding the web being disposed in said frame.

12. A system as set forth in claim 11 including optical sensor means at the output feed station for controlling the table as to its vertically-disposed height, and switch means having box and roll modes, said switch means enabling said optical sensor means in the box mode and disabling the optical sensor means in the roll mode.

13. A system as set forth in claim 12 wherein said optical sensor means comprises a pair of sensors.

14. A system as set forth in claim 13 including a limit switch associated with said table, said limit switch also controlled from said switch means.

15. A system as set forth in claim 1, the output first support means comprises guide roller means and said output second support means comprises support table means.

16. A system as set forth in claim 15, wherein said input first support means comprises guide roller means and said input second support means comprises support table means.

17. A system as set forth in claim 16, wherein the input support table means comprises a cover means that may be moved between alternate positions and when moved to its horizontal position is adapted to support the web in a folded form.

18. A system as set forth in claim 1, wherein said input first support means comprises guide roller means and said input second support means comprises support table means.

* * * * *